US005199913A

United States Patent [19]

Toyohara et al.

[11] Patent Number: 5,199,913

[45] Date of Patent: Apr. 6, 1993

[54] SMALL, JET-PROPELLED BOAT

[75] Inventors: Makoto Toyohara; Hiroshi Tasaki, Hamamatsu, both of Japan

[73] Assignee: Sanshin Kogyo Kabushiki Kaisha, Japan

[21] Appl. No.: 884,763

[22] Filed: May 18, 1992

[30] Foreign Application Priority Data

May 16, 1991 [JP] Japan ..... 3-141137

[51] Int. Cl.[5] ..... B63H 11/103

[52] U.S. Cl. ..... 440/47; 440/38; 114/270

[58] Field of Search ..... 440/38–43, 440/46, 47; 114/270

[56] References Cited

U.S. PATENT DOCUMENTS 3,805,731 4/1974 Furst et al. ..... 440/47

4,449,944 5/1984 Baker et al. ..... 440/41

FOREIGN PATENT DOCUMENTS 1-145598 3/1988 Japan .

127187 5/1990 Japan ..... 440/47

*Primary Examiner*—Jesûs D. Sotelo

*Attorney, Agent, or Firm*—Bacon & Thomas

[57] ABSTRACT

A jet-propelled craft includes a hull, an engine installed within the hull, a duct positioned in the stern area of said hull, and an impeller which is turned by the rotational force of the engine to create a jet stream within the duct. The craft also includes left and right secondary water-intake openings on the bottom of the hull which are positioned a specific distance apart on the left and right in the hull, the duct including branches connected to the left and right secondary water-intake openings. By equipping the secondary water-intake openings with a valve which closes when a sharp turn is made in the above mentioned boat and the valve is on the outside with respect to the direction of the turn, air is prevented from entering the outside secondary duct and a loss of propulsive force is prevented.

15 Claims, 5 Drawing Sheets

SMALL, JET-PROPELLED BOAT

BACKGROUND OF THE INVENTION

1. Field of the Invention

This invention concerns a small, jet-propelled boat. In particular, it concerns a small, jet-propelled boat in which lowered propulsive force during sharp turns can be prevented.

2. Description of Related Art

In the past, when making sharp turns in a small, jet-propelled boat, the operator of the boat would lean his body weight toward the inside of the turn. When this was done in the usual type of small, jet-propelled water craft having just one water intake opening located in the bottom center of the hull, the water intake opening tended to rise above the surface of the water with just a small part of it remaining submerged. The result was that a large volume of air would be taken in, impeding water intake and causing a dramatic drop in propulsion. To prevent this type of lowered propulsion, it was proposed (see, for example, Japan Utility Patent Application Publication Hei 1-145598) to provide two water intake openings which were separate and independent of each other and which were positioned left and right on the hull a specific distance apart. However, the proposed solutions in Japan Utility Patent Application Publication Hei 1-145598 and their prior art examples did not sufficiently attain their objective of preventing the drop in propulsion.

Because both of the water intakes and the duct were always open during turns, and although no air would be taken in at the intake opening on the inside of the turn, the intake on the outside would bring in a large amount of air because it was positioned above the surface of the water, resulting in decreased propulsion.

A principal objective of this invention is to reduce the amount of air intake during turns to an absolute minimum and to thereby prevent the resultant drop in propulsion.

SUMMARY OF THE INVENTION

In order to achieve the above-specified objective, the invention provides a small, jet-propelled boat which includes a hull and an engine installed within the hull, a duct positioned in the stern area of the hull, an impeller which is turned by the rotational force of the engine and which creates a jet stream within the duct, and left and right secondary water-intake openings on the bottom of the hull which are positioned a specific distance apart on the left and right in the hull. The duct branches left and right on the upstream side and connects to the left and right secondary water-intake openings, which are equipped with a valve to open and close them so that when a sharp turn is made in the boat, the outside duct valve, with respect to the direction of the turn, is closed.

The invention therefore establishes secondary water-intakes on the left and right sides of the hull and also provides valves for the opening and closing of those intakes. When a sharp turn is made, the valve on the outside secondary water-intake is closed so that it can take in no water. Accordingly, this also prevents air from being drawn in from the part of the secondary water-intake which is positioned above the surface. Since the valve on the inside side of the turn remains opened and since that secondary water-intake remains deeply submerged below the water surface, only water, and no air is taken in through that secondary water-intake.

DETAILED DESCRIPTION OF THE PREFERRED EMBODIMENTS

FIGS. 1 through 7 show an embodiment of a small, jet-propelled boat constructed in accordance with the principles of a preferred embodiment of the invention.

Figure 1:
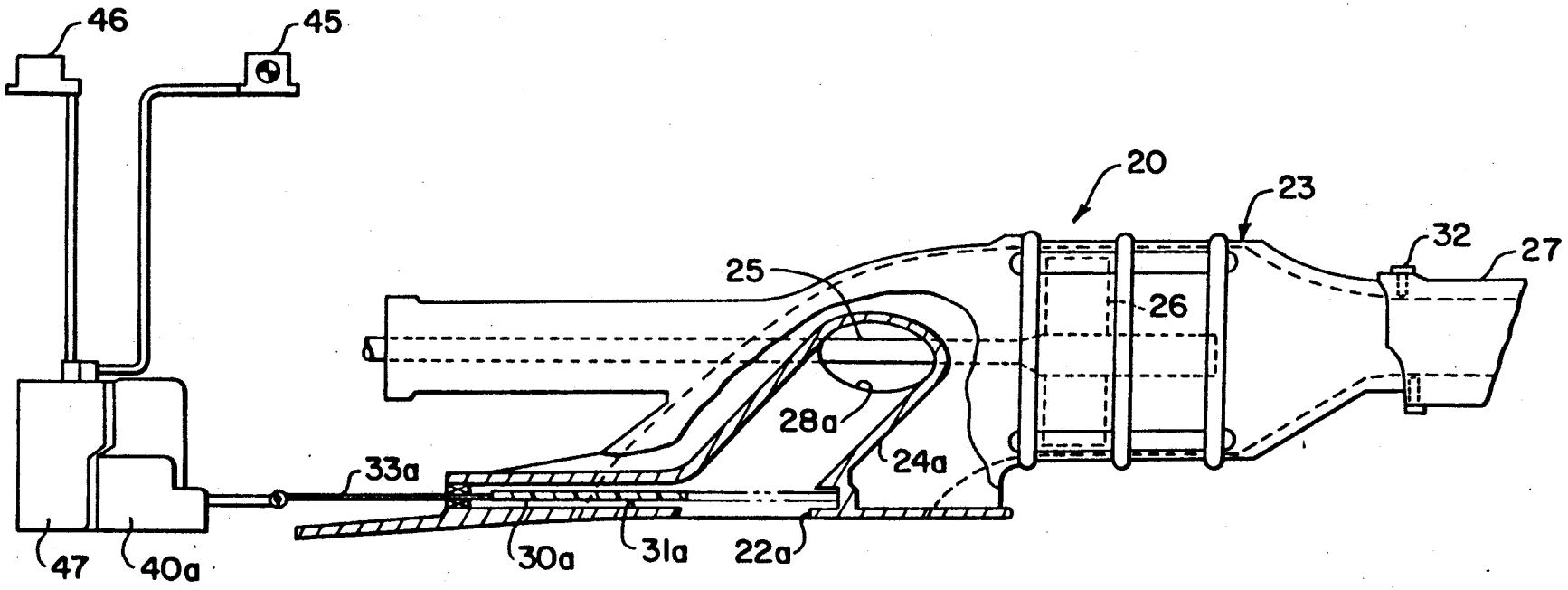
FIG. 1 is a partial cross-sectional side view of a pump unit for use in a small, jet propelled boat constructed in accordance with the principles of a preferred embodiment of the invention.
Figure 3:
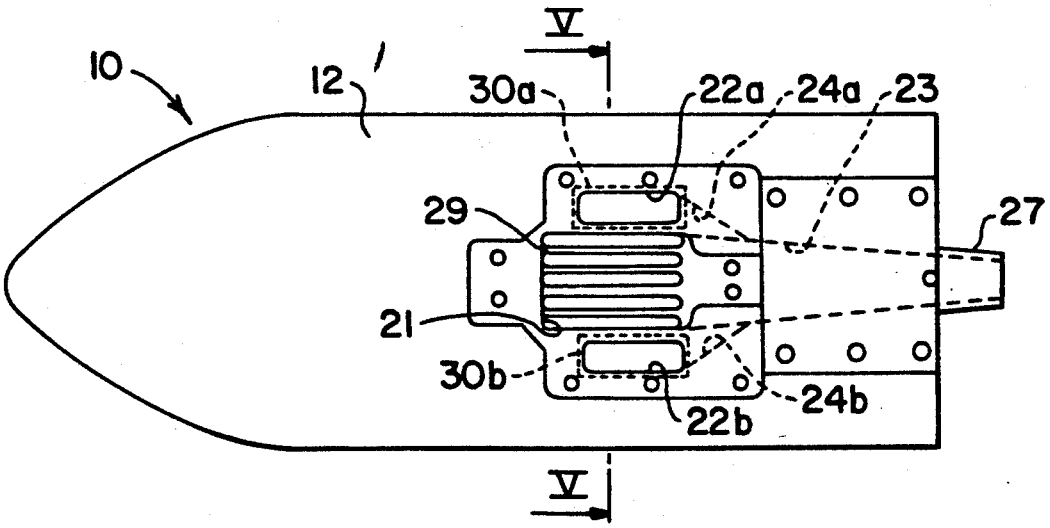
FIG. 3 is a bottom view of the preferred small, jet-propelled boat, shown while proceeding straight ahead.
Figure 5:
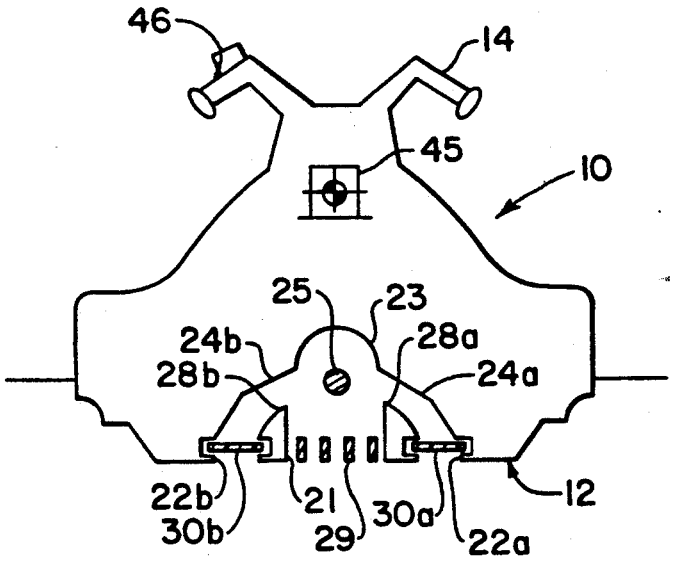
FIG. 5 is a cross-sectional side view taken along line V—V of FIG. 3.

Referring to FIGS. 1, 3 and 5, the preferred jet-propelled boat includes a hull 10, a bottom 12, a steering wheel 14, a pump unit 20, and a nozzle 27 which pivots on pivot shaft 32 according to whether steering wheel 14 is set straight-ahead or to the side.

The pump unit 20 is attached to the stern area of the hull 10. Pump unit 20 creates propulsion to drive the boat 10 by means of an engine (not shown) which drives the pump in known fashion by causing the pump to forcefully expel water in response to rotation of an impeller, 26.

Figure 2:
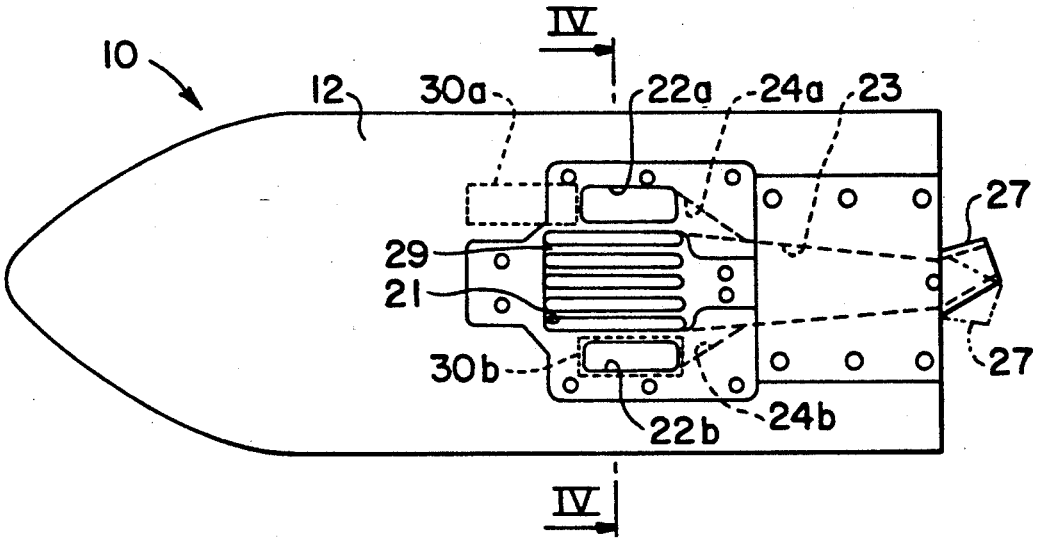
FIG. 2 is a bottom view of the preferred small, jet-propelled boat shown while making a left turn.

At the center of the bottom of boat 12, in the left-right direction of the hull 10 as shown in FIGS. 2 and 3, is the main water intake 21 which is a roughly rectangular opening following the contours of the bottom of the boat 12. This main water intake opening 21 connects to main duct 23, which initially slopes upward, then stays horizontal as it extends toward the stern where it connects to nozzle 27, best shown in FIG. 1. Inside the horizontal part of the main duct 23 is a drive shaft 25. Drive shaft 25 is connected at the front to the engine (not shown) mounted on the hull 10, and at the rear, to impeller 26. The rotation of the engine rotates impeller 26 creating a jet stream within main duct 23.

On the left and right sides of the main water intake opening 21 in the hull 12 are secondary water-intakes 22*a* and 22*b* which are positioned a small interval away from main intake 21. Secondary intakes 22*a* and 22*b* are rectangular, with the long sides of the rectangle being parallel to the direction of propulsion. These secondary water-intake openings 22*a* and 22*b* are connected, respectively, to secondary ducts 24*a* and 24*b*. As shown in FIG. 5, secondary ducts 24*a* and 24*b* extend in close proximity to the main duct as they extend upward, and as shown in FIG. 1, they slope upward as they extend along the main duct toward the rear. Secondary ducts 24*a* and 24*b* are joined to the main duct 23 in the area where the main duct runs horizontally, opening into flow mixing openings 28*a* and 28*b* where the flow of the secondary ducts 24a and 24b is combined with that of the main duct 23.

Water intake screen 29 is attached to the main water intake. This water intake-screen has a plurality of rectangular openings with the long sides of the rectangles being parallel to the direction of propulsion. The function of the water-intake screen 29 is to prevent the entry of foreign materials into the main duct 23. Secondary water-intakes 22a and 22b are equipped, respectively, with slide valves 30a and 30b and valve grooves 31a and 31b in which the valves are free to slide forward and backward. When these slide valves 30a and 30b are moved forward (the condition shown by the solid lines in FIG. 1), the secondary water-intake openings 22a and 22b are free. As will be described below, this allows water to be drawn into the secondary ducts 24a and 24b. Conversely, when slide valves 30a and 30b are moved to the rear, the secondary water-intake openings 22a and 22b are closed, preventing entry of water into secondary ducts 24a, 24b.

Connecting rods 33a and 33b are attached to slide valves 30a and 30b, respectively. Connecting rods 33a and 33b are also connected to DC motors 40a and 40b. These connections allow the DC motors 40a and 40b, through their respective connecting rods 33a and 33b, to operate the slide valves 30a and 30b fore and aft, thereby opening and closing secondary water-intake openings 22a and 22b, in response to valve drive controller 47.

Figure 6:
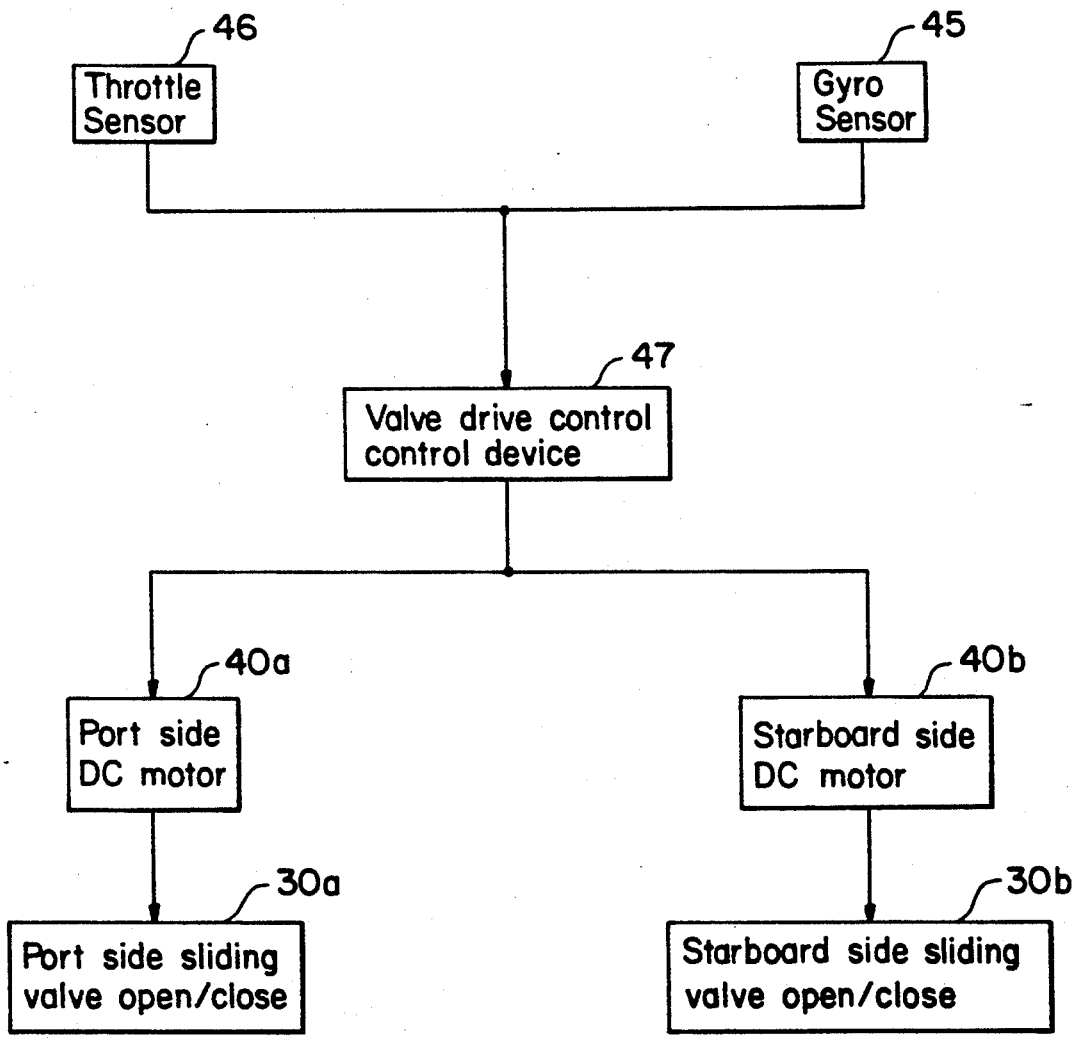
FIG. 6 is a block diagram of a valve control device for controlling opening and closing of the sliding valves.
Figure 7:
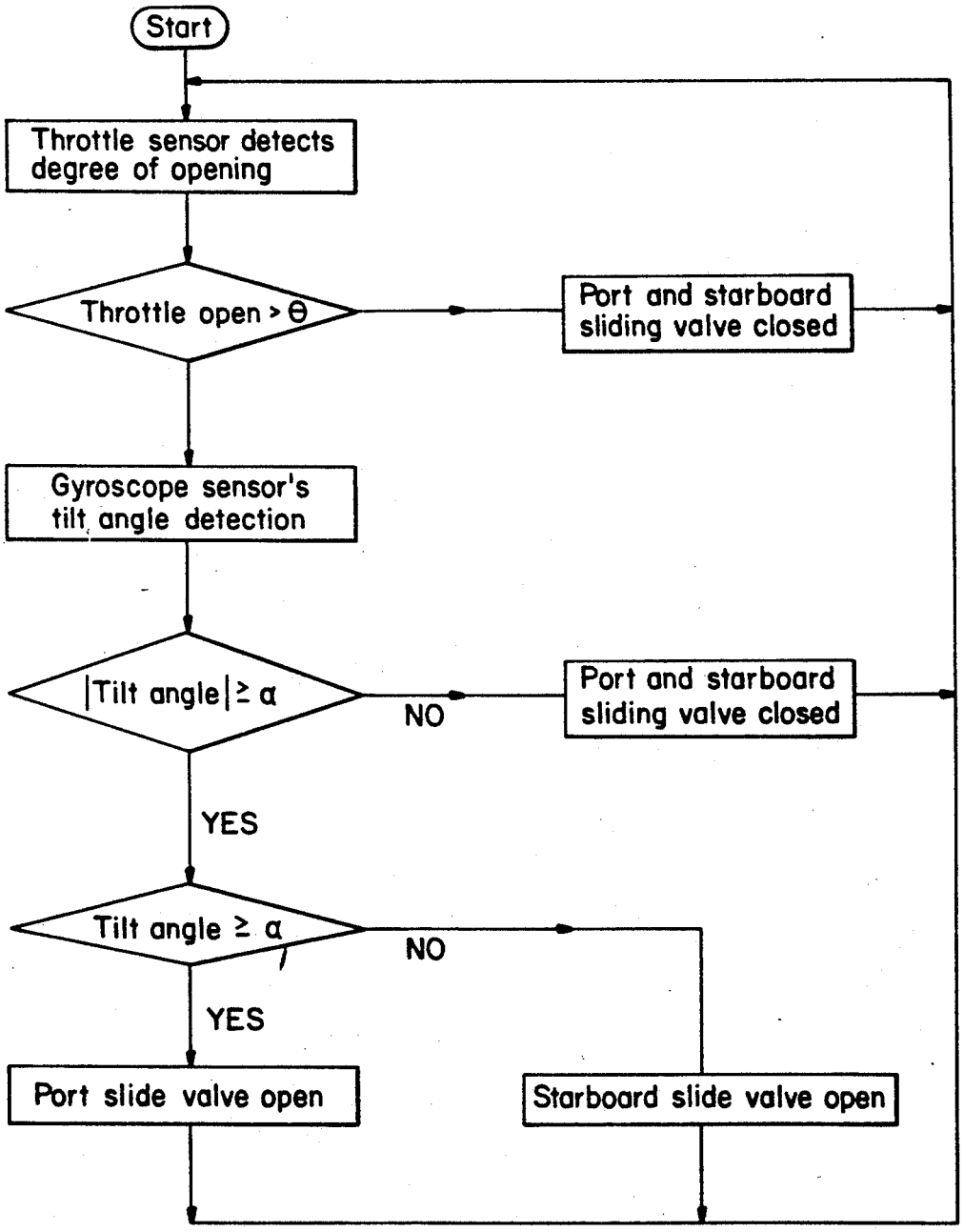
FIG. 7 is a flow chart showing the drive control for the sliding valve.

As shown in FIG. 1, a gyro sensor 45 is provided for detecting the left-right tilt of the boat 10, and a throttle sensor 46 for detecting the opening of an engine throttle valve (not shown). Valve drive controller 47 drives DC motors 40a and 40b. As shown in FIG. 6, the throttle sensor 46 and gyro sensor 45 are connected to valve drive controller 47, and valve drive controller 47 separately controls DC motors 40a and 40b as will be described in more detail below.

Straight-ahead propulsion will now be described with reference to FIGS. 1, 3 and 5. In response to actuation of a throttle (not shown), the throttle valve is opened and the engine rotates. This rotational force is transmitted by the drive shaft 25 to impeller 26, causing it to turn. The rotation of the impeller 26 creates a jet stream within the main duct 23. Water is drawn in through the main water intake opening 21, traverse the main duct 23, and is expelled rearward as a jet flow from nozzle 27, the force of which propels the boat 10 forward. At this time, as shown by the broken, imaginary lines in FIG. 1, secondary water-intake openings 22a and 22b are open by slide valves 30a and 30b and there is no water entering secondary ducts 24a and 24b. To wit, when the preferred boat is propelled straight ahead, there is no water intake from the secondary water-intake openings 22a and 22b, and the water only enters through the main water intake opening 21.

Figure 4:
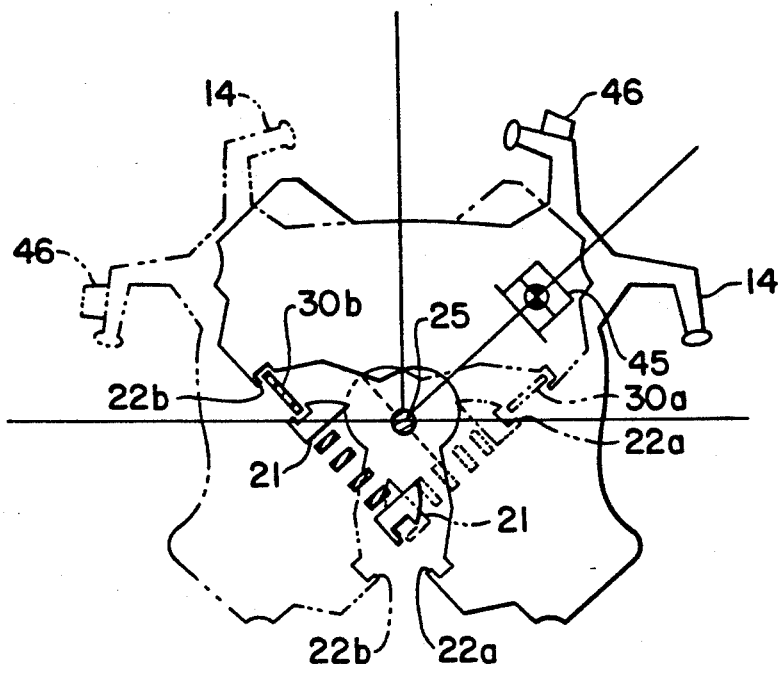
FIG. 4 is a cross-sectional side view taken along line IV—IV of FIG. 2.

Operation during turning will now be explained with reference to FIGS. 1, 2 and 4. In the case where the steering wheel 14 is turned to the left to make a slow and/or wide turn, the nozzle 27 is directed so that the jet stream points to the left, causing the boat 10 to turn left while the operator keeps the boat in a vertical position. In this case, because the boat 10 has not tilted, the gyroscopic sensor 45 allows slide valves 30a and 30b to remain in the closed position. In this position, the only water intake that occurs is from the main water intake 21.

When making a sharp and/or fast turn to the left by operating the steering wheel 14, the body weight of the operator shifts to the port side, in other words, the operator leans to the inside of the turn. When this happens, the boat 10 tilts toward the port side such as shown by the solid line in FIG. 4, and this causes the secondary water-intake opening 22a on the port side, which is the inside side of the turn, to be deeply immersed in the water. On the other hand, on the starboard side, which is the outside side of the turn, secondary water-intake opening 22b rises above the surface of the water. The gyro sensor 45 detects the angle of tilt toward the left and as a result, transmits a signal to the drive controller 47. In addition, throttle sensor 46 detects the degree to which the throttle valve (not shown) is open, and those results are also transmitted to the valve drive controller 47. If the degree of opening of the throttle valve is above a certain angle ($\theta$ for example) and if the tilt angle of the boat is above a certain angle ($\alpha$ for example), then drive motor 40a on the port side (the side toward which the boat is tilting) is activated, and the slide valve on the port side 30a is opened. At this time, the starboard slide valve 30b remains in the closed position. The result of this is that secondary duct 24a on the port side is opened to water from the secondary water-intake opening 22a and water is taken in. The main water intake opening 21 remains open at all times, so water intake is accomplished by both secondary water-intake opening 22a and main water intake opening 21. However, on the starboard side, i.e., the side on the outside of the turn, secondary water-intake opening 22b remains closed so that no water can enter, the secondary water-intake opening 22b being positioned above the water's surface at this time. This avoids the problem of air being drawn into the impleller 26. This prevention of the invasion of air strongly reduces drops in propulsive force.

In the case where a right turn is made, the steering wheel 14 is turned toward the right and the body weight of the operator is shifted to the starboard side, i.e., toward the inside of the turn. When this happens, the hull of the boat 10 tilts toward the starboard side and the starboard side secondary water-intake opening 22b on the inside of the turn becomes deeply submerged below the water's surface. On the other hand, the port side secondary water-intake opening 22a on the outside of the turn is raised above the surface of the water. Gyro sensor 45 detects the tilt toward the right and transmit that information to the valve drive control device 47. The throttle valve opening is also detected by sensor 46 at this time. If the throttle valve opening is above a certain level, and if the tilt of boat 10 is beyond a certain angle, controller 47 causes the DC motor 40b on the starboard side to be activated to open the starboard side sliding valve 30b. At this time, the port side sliding valve 30a REMAINS closed.

The result is that starboard side secondary water-intake opening 22b, on the inside of the turn, takes in water through secondary duct 24b. Meanwhile, the main water intake 21 always remains open, but the port side secondary water-intake opening 22a, i.e., the opening on the outside of the turn, REMAINS closed and does not take in any water. Since the water is taken in only from the deeply submerged inside secondary water-intake opening 22b and the main intake opening 21, which is below the water's surface, it is difficult for air to be introduced into the impeller 26. This works to strongly inhibit any drop in propulsion which might be caused by such air introduction.

Next, when the sharp turn has been completed and the boat begins to move straight ahead, the operator shifts his weight toward the center as he returns the steering wheel 14 to the straight-ahead position. When this happens, the boat 10 returns to an upright position from a tilted position and nozzle 27 is directed for motion straight ahead. At this time, the gyro sensor 45 detects the tilt angle of the boat 10, and the valve drive control device 47 drives either DC motor 40*a* or 40*b* in order to close the outside sliding valve 30*a* or 30*b*. As a result, both the left and right sliding valves 30*a* and 30*b* are in a closed condition (see FIG. 5) and water intake takes place only through the main water intake opening 21.

When the throttle valve opening is below a certain level as detected by sensor 46, in other words, when the craft is operated at a low speed, even if the gyro sensor 45 detects that the boat 10 is tilted beyond a certain angle, the valve drive control device 47 will not open either of the secondary water-intake valves.

Having thus described a specific preferred embodiment of the invention, it will nevertheless be appreciated that numerous variations will undoubtedly occur to those skilled in the art. For example, in the above-described exemplary preferred embodiment, the main water intake opening and the secondary water-intake openings were established separately. However, there does not necessarily have to be a main water intake opening at all. In such a case, both of the sliding valves would be open when the craft is running straight and, during sharp turns, only the sliding valve on the outside of the turn would be closed. Also, in the preferred embodiment, sliding valves are used, but it is also possible to use other valve types, such as rotating valves. Moreover, the preferred valves are mounted at the secondary water-intake openings so as to prevent the taking in of water, but it would also be possible to locate them a short distance away from these openings. Finally, the above described preferred embodiment uses just one secondary water-intake opening each on the left and right sides of the hull, but it would of course be possible to use more than one on each side, or to use none on one side. Accordingly, it is to be understood that the invention is to be interpreted solely as set forth in the appended claims, and is not to be limited by the above description.

We claim:

1. A jet-propelled boat including a hull, a bottom side of which is under water when operating the boat, a main duct positioned in the hull, impeller means within the main duct for creating a jet stream within the main duct, and first and second water-intake openings on the bottom of the hull positioned a predetermined distance apart on opposite sides of the hull and connected by respective duct branches to the main duct;

means including valves positioned to selectively open and close each of the first and second water-intake openings; and means for controlling said valves to close one of said first and second openings when a turn is made in said boat such that said one of said openings which is positioned on the outside of said boat with respect to a direction of the turn is always closed to thereby prevent air from entering said one of said openings when it is exposed to the air during the turn so that only the opening which is positioned on the inside of said boat with respect to the direction of the turn will be open.

2. A boat as claimed in claim 1, wherein said main duct includes a main intake opening positioned at a center of the bottom of the hull such that said main intake opening is always open and always under water during operation of said boat.

3. A boat as claimed in claim 1, wherein said means for controlling said valves includes means for detecting a deviation of said boat from a vertical position during the turn and for controlling said valves such that said one of said first and second openings remains closed in response to detection that the deviation exceeds a predetermined angle.

4. A boat as claimed in claim 3, wherein said means for controlling said valves includes a gyroscopic sensor.

5. A boat as claimed in claim 3, wherein said means for controlling said valves further comprises means including a throttle position sensor for detecting whether an engine throttle has been opened beyond a predetermined position and for preventing opening of said valves unless said throttle has been opened beyond the predetermined position.

6. A boat as claimed in claim 1, wherein said means for controlling said valves further comprises means including a throttle position sensor for detecting whether an engine throttle has been opened beyond a predetermined position and for preventing opening of said valves unless said throttle has been opened beyond the predetermined position.

7. A boat as claimed in claim 1, wherein said valves are sliding valves.

8. A boat as claimed in claim 1, wherein said means for controlling said valves includes DC motors arranged to selectively move said valves to close one of said first and second openings.

9. A jet-propelled boat including a hull, a bottom side of which is under water when operating the boat, a main duct including a main intake opening positioned at a center of the bottom of the hull such that said main intake opening is always under water during operation of said boat, impeller means within the main duct for creating a jet stream within the main duct, and a secondary water-intake opening on the bottom of the hull positioned a predetermined distance from the main intake opening and connected by a duct branch to the main duct;

valve means including a valve positioned to selectively open and close said secondary water-intake opening; and valve control means for controlling said valve to close said secondary water-intake opening when said secondary water-intake opening is positioned on an outside of said boat with respect to a turning direction to thereby prevent air from entering said secondary intake opening when it is exposed to the air during a turn.

10. A boat as claimed in claim 9, wherein said valve control means includes means for detecting a deviation of said boat from a vertical position and for controlling said valve to close said secondary water-intake opening in response to detection that the deviation exceeds a predetermined angle.

11. A boat as claimed in claim 10, wherein said valve control means includes a gyroscopic sensor.

12. A boat as claimed in claim 10, wherein said valve control means further comprises means including a throttle position sensor for detecting whether an engine throttle has been opened beyond a predetermined position and for preventing opening of said valve unless said throttle has been opened beyond the predetermined position.

13. A boat as claimed in claim 9, wherein said valve control means further comprises means including a throttle position sensor for detecting whether an engine throttle has been opened beyond a predetermined position and for preventing opening of said valve unless said throttle has been opening beyond the predetermined position.

14. A boat as claimed in claim 9, wherein said valve is a sliding valve.

15. A boat as claimed in claim 14, wherein said valve control means includes a DC motor arranged to selectively move said valve to close said secondary water-intake opening.

* * * * *